US006348900B1

(12) United States Patent
Blom

(10) Patent No.: US 6,348,900 B1
(45) **Date of Patent: *Feb. 19, 2002**

(54) ANTENNA ASSEMBLY

(75) Inventor: Carl Gustaf Blom, Lysekil (SE)

(73) Assignee: Monteco AB (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/491,188

(22) Filed: Jan. 25, 2000

Related U.S. Application Data

(63) Continuation of application No. 08/974,306, filed on Nov. 17, 1997, now Pat. No. 6,064,346, which is a continuation of application No. PCT/SE96/00608, filed on May 9, 1996.

(30) Foreign Application Priority Data

May 19, 1995 (SE) ..... 9501872
May 19, 1995 (SE) ..... 9501873

(51) Int. Cl.[7] ..... H01Q 1/36
(52) U.S. Cl. ..... 343/895; 343/745; 343/900
(58) Field of Search ..... 343/900, 722, 343/745, 702, 749, 752, 895, 829; H01Q 1/36, 9/00, 9/32

(56) References Cited

U.S. PATENT DOCUMENTS

| | | | | |
|---|---|---|---|---|
| 2,636,122 A | | 4/1953 | Hayes | |
| 2,894,260 A | | 7/1959 | Ellis | |
| 3,825,864 A | | 7/1974 | Ramstrom | |
| 4,080,604 A | | 3/1978 | Wosniewski | |
| 4,462,033 A | | 7/1984 | Grashow et al. | |
| 4,725,845 A | | 2/1988 | Phillips | |
| 4,980,695 A | | 12/1990 | Blaese | |
| 5,563,615 A | | 10/1996 | Tay et al. | |
| 6,064,346 A | * | 5/2000 | Blom | 343/749 |

* cited by examiner

*Primary Examiner*—Tho Phan
(74) *Attorney, Agent, or Firm*—McGarry Bair LLP

(57) ABSTRACT

An antenna apparatus for a communication device operating in the frequency range of between 800 and 3000 MHz, comprises at least one radiator (1), which is galvanically connected to one end of a spiral conductor (2). This is, in turn, connected to a transceiver (4). An earthed conductor (6) extends along the extent of the spiral (2) to form a capacitance therewith distributed along the spiral.

9 Claims, 7 Drawing Sheets

ANTENNA ASSEMBLY

This application is a continuation of U.S. patent application Ser. No. 08/974,306, filed Nov. 17, 1997, now U.S. Pat. No. 6,064,346 which is a continuation of International Patent Application No. PCT/SE96/00608 filed on May 9, 1996, pending, which claims priority from Sweden Application Nos. 9501872-7 and 9501873-5, both filed on May 19, 1995.

TECHNICAL FIELD

The present invention relates to an antenna apparatus for a communication device operating in the frequency range of between 800 and 3000 MHz, comprising at least one radiator which is Galvanically connected to one end a of a spiral conductor which in turn is connected to a transceiver.

BACKGROUND ART

The connection impedance to a transceiver of the type employed in so-called mobile telephones is often of the order of magnitude of 50 ohm. Depending, upon the design and type of radiator, its impedance may vary greatly, for example, within the range of between 100 and 1000 ohm. Thus, adaptation of the impedance is necessary.

In prior art designs and constructions, it is normal to build up an adaptation network of discrete components which are often placed on a circuit card in the communication device. Even if impedance adaptation in such designs and constructions may be satisfactory, these designs and constructions are generally expensive and suffer from high losses. Further, it is not possible, in this type of adaptation network, simply to include the antenna construction proper, as would be desirable since this would realise a simple and compact integral construction.

In mobile telephones in the stand-by mode, i.e., when the mobile telephone device is ready for receiving an incoming, signal, a small and compact antenna is further required, which, moreover must be mechanically durable and well protected. The degree of efficiency of such an antenna need not be sufficient to give complete range and transmission quality in the activated state, i.e., during talks. In order to realise a higher degree of efficiency in the antenna, use is often made of a retractable antenna which is employed in the activated state. Such a construction also presupposes the incorporation of an adaptation network between the antenna/antennas and the transceiver. There is a serious need in the art that all of these components can be downscaled to miniature and given good mechanical protection.

Problem Structure

The present invention has for its object to realise an apparatus which obviates the problems inherent in prior art constructions. Thus, the present invention has for its object to realize an antenna apparatus which may have one or two radiators and which has an integrated adaptation network, in which the adaptation network has a high degree of efficiency, is mechanically stable and extremely space-saving. The present invention further has for its object to realize an apparatus which is simple and economical in manufacture.

Solution

The invention relates to an antenna apparatus for a communication device operating in the frequency range of between 800 and 3000 MHz. The antenna apparatus is of the type having at least one radiator which is galvanically connected to one end of a spiral conductor, which, in turn is connected to a transreceiver at a connection point. The apparatus is characterized in that an earthed conductor extends along the extent of the spiral so that substantially all ofthe capacitance formed by the position of the earthed conductor is distributed along the spiral conductor.

In one aspect of the invention, the connection point is located on an opposite end of the spiral spaced away from the radiator. In another aspect, the connection point is disposed between the ends of the spiral.

In yet another aspect of the invention, the spiral and the transreceiver are galvanically interconnected with one other. Also, the axial direction of the spiral can be substantially parallel to the longitudinal direction of the radiator.

Preferably, the spiral is substantially of helical configuration and the earthed conductor is disposed concentrically in the spiral. An air space can lie between the earthed conductor and the inside of the spiral. In another embodiment, a sleeve of dielectric material is disposed about the earthed conductor with the spiral being wound on the sleeve.

In a first embodiment, the spiral is substantially helical in configuration, while the earthed conductor is disposed concentrically in the spiral.

In a second embodiment, the spiral is substantially planar, which also applies to the earthed conductor which has an outer contour approximately adhering to the outer contour of the spiral.

Further advantages will be attained according to the present invention if the subject matter of the present invention is also given one or more of the characterizing features as set forth in appended subclaims 4 to 15.

BRIEF DESCRIPTION OF THE ACCOMPANYING DRAWINGS

The present invention will now be described in greater detail hereinbelow, with particular reference to the accompanying drawings. In the accompanying drawings.

DESCRIPTION OF PREFERRED EMBODIMENTS

Figure 1:
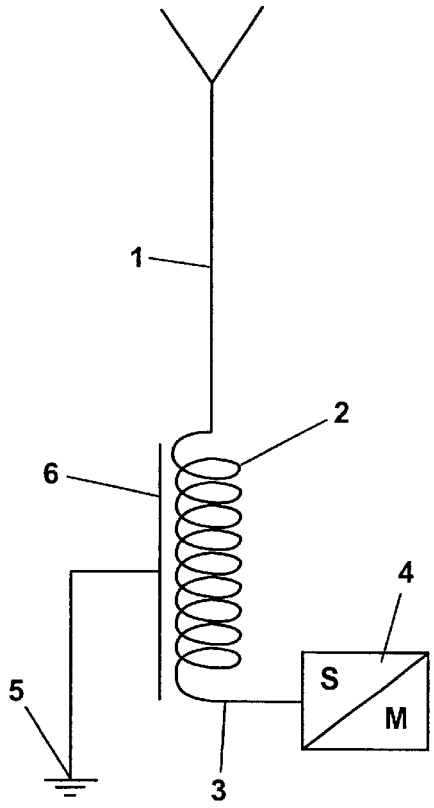
FIG. 1 is an electric equivalent diagram of the present invention.

In FIG. 1, reference numeral 1 relates to a radiator which is galvanically connected to one end of a helical conductor or coil 2, i.e., an inductance. The coil 2 has an input point 3 via which it is connected to a transceiver 4. In connection with the coil 2, there is provided a conductor 6 connected to earth at 5, the conductor extending along the coil 2 and having the same spatial extent as the coil. There will thereby be formed between the coil 2 and the earthed conductor 6 a capacitance distributed along the coil. The coil 2 and the earthed conductor 6 form an adaptation network which transforms the higher impedance of the radiator to a value of the order of magnitude of 50 ohm, which corresponds with the 50 ohm of the transceiver.

The apparatus according to FIG. 1 may operate both as a quarter wave antenna and as a half wave antenna. If the antenna is set for the 800 MHz band and quarter wave operation it will, as half wave antenna, be set for approximately 1600 MHz, i.e. approximately twice the lower frequency.

Figure 2:
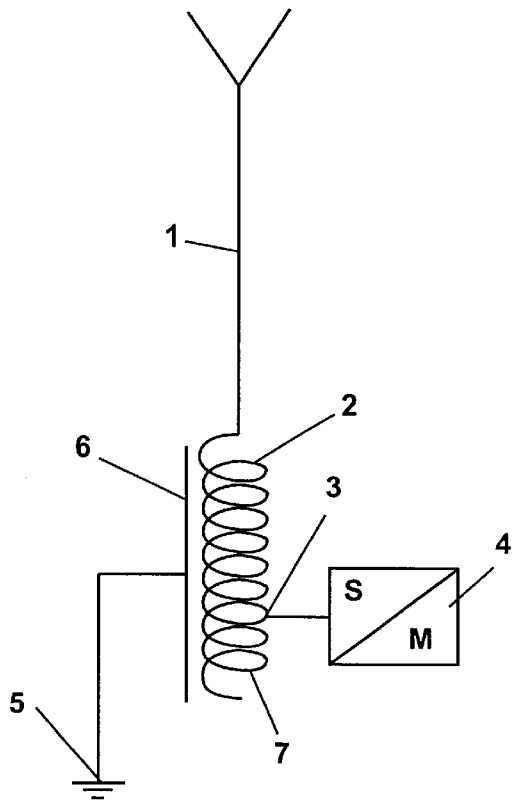
FIG. 2 shows a modified embodiment of the present invention according to FIG. 1.

FIG. 2 shows a variation of the present invention in which the relationship between the resonance frequencies in half wave operation and quarter wave operation deviates from 2. This has been realized by a displacement of the input point 3 along the coil 2 so that the coil extends on both sides of the input point. Because of the extra impedancc which is realized by the free portion 7 of the coil, the radiator 1 is seen electrically to be longer than it actually is. This implies that it will be resonant at a lower frequency than would have been the case in a pure quarter wave radiator.

In half wave operation, because of the extra capacitance the coil will be seen as shorter than would have been the case for a pure half wave adaptation. This gives a shorter antenna, for which reason the resonance frequency will be higher than would have been the case in a pure half wave antenna. By suitable dimensioning it is thus possible to cause the antenna to operate as a quarter wave antenna in the 800 MHz band while operating as a half wave antenna in the 1900 MHz band. The relationship between the two frequencies is here greater than 2.

Figure 3A:
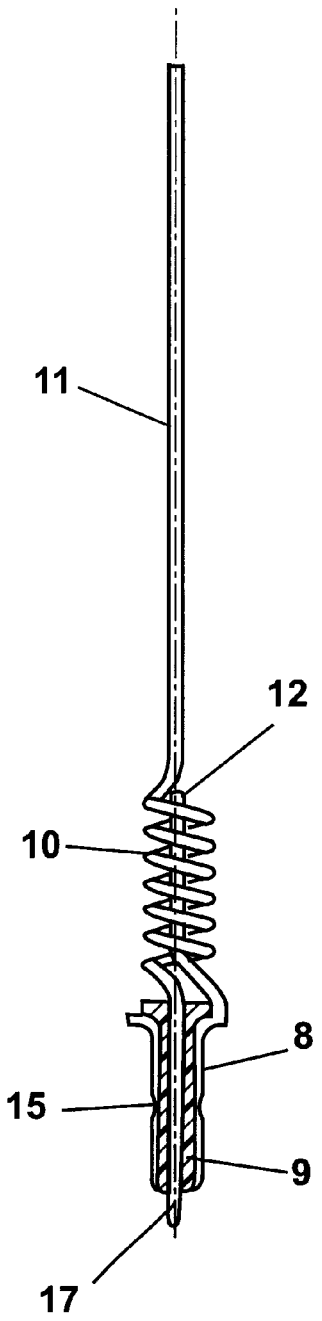
FIG. 3A shows one practical version of the present invention according to FIG. 1.
Figure 3B:
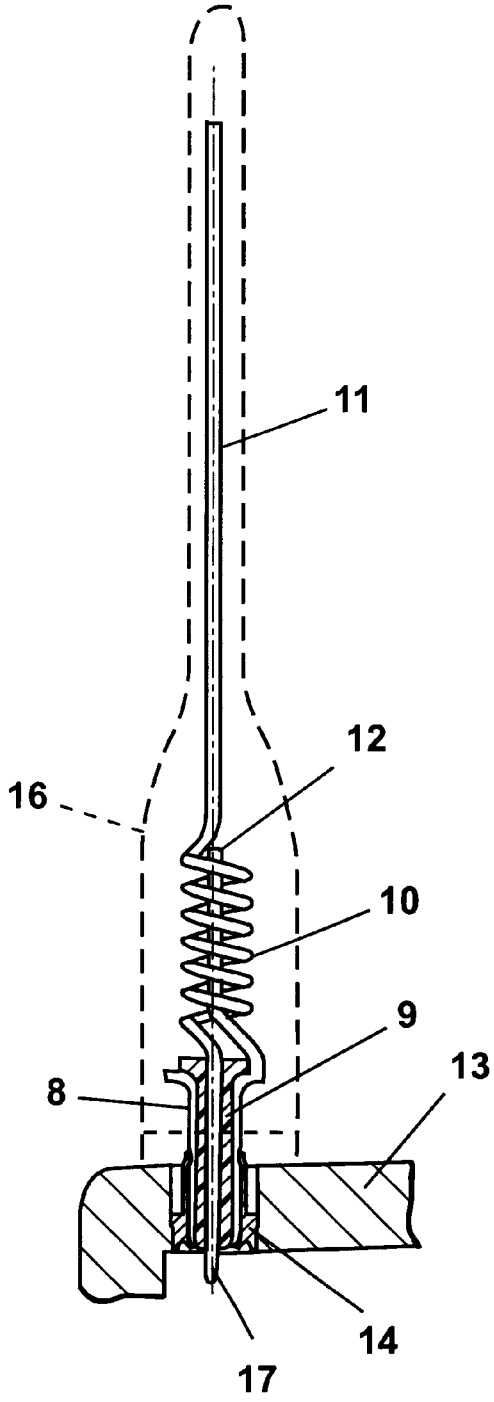
FIG. 3B shows the practical version of FIG. 3A installer in a socket.

FIG. 3 shows an example of a physical array construction of an apparatus according to FIG. 1. The antenna according to FIG. 3 has a sleeve 8 which is earthed in the apparatus and is provided with an internal insulator 9. A contact pin 17 extends concentrically through the insulator and merges, on the upper side of the sleeve 8, into a spiral conductor, preferably of helical configuration, or a coil 10. The radiator proper is connected at the upper end of the coil 10 and, in this embodiment, the radiator is designed as a rod antenna 11. Suitably, the coil 10 is designed as a cylindrical helix with constant pitch along its length, and the rod extends along the axial direction of the coil.

In FIG. 3, the earthed conductor carrying reference numeral 6 in FIG. 1 has its counterpart in a straight conductor 12 which is disposed interiorly in the coil 10. The conductor 12 extends concentrically along the entire Length of the coil 10 and thereby forms a capacitance with the coil 10 which is distributed continually over the coil 10. Suitably, the conductor 12 is enveloped by a tube or a sleeve of a dielectric material so that the capacitance may thereby be increased. The tube consists, for example, of polytetrafluoroethene (which is sold under the trademark Teflon®) and may serve as winding support when the coil 10 is wound thereon. In its lower end, the conductor 12 is galvanically connected to the earthed sleeve 8. It will also be apparent that the conductor 12 and the rod antenna 11 are suitably coaxial or approximately coaxial with one another.

In the right-hand portion of FIG. 3, it is shown how the earthed sleeve 8 is inserted in a socket 14 provided in the casing 13 of the device, the socket having a mechanical connection arrangement with resilient tongues for snap-in action into a circumferential groove 15 in the sleeve 8. It will further be apparent that the entire antenna apparatus may be cast in an insulating protective housing which is indicated by the ghosted line 16.

In one practical version, the antenna according to FIGS. 1 and 3 has, in half wave design, a rod length of approximately 110 mm in the 900 MHz band, and approximately 50 mm in the 1800 MHz band. The wire diameter in the rod 11 and in the coil 10 is approximately 0.8 mm and the coil has an inner diameter of approximately 1.5 mm. On setting to 1800 MHz, the coil has approximately 7 turns while the number of turns is approximately 12 in 900 MHz.

Figure 4A:
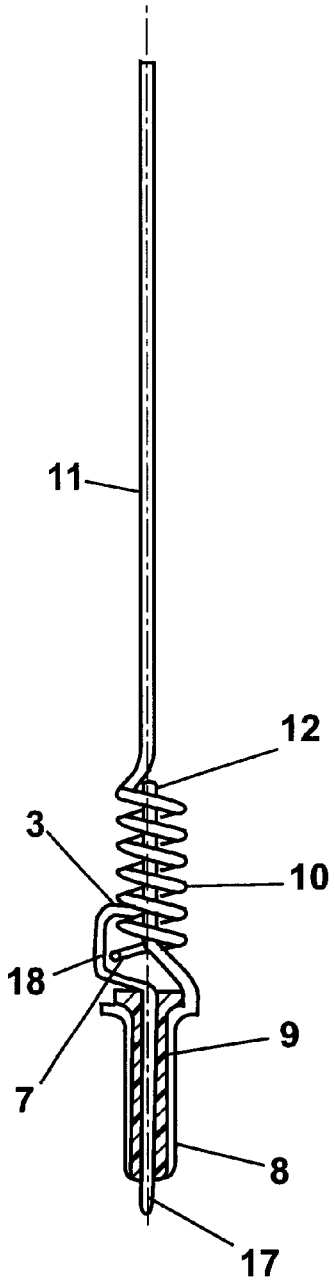
FIG. 4A shows one practical version of the present invention according to FIG. 2.
Figure 4B:
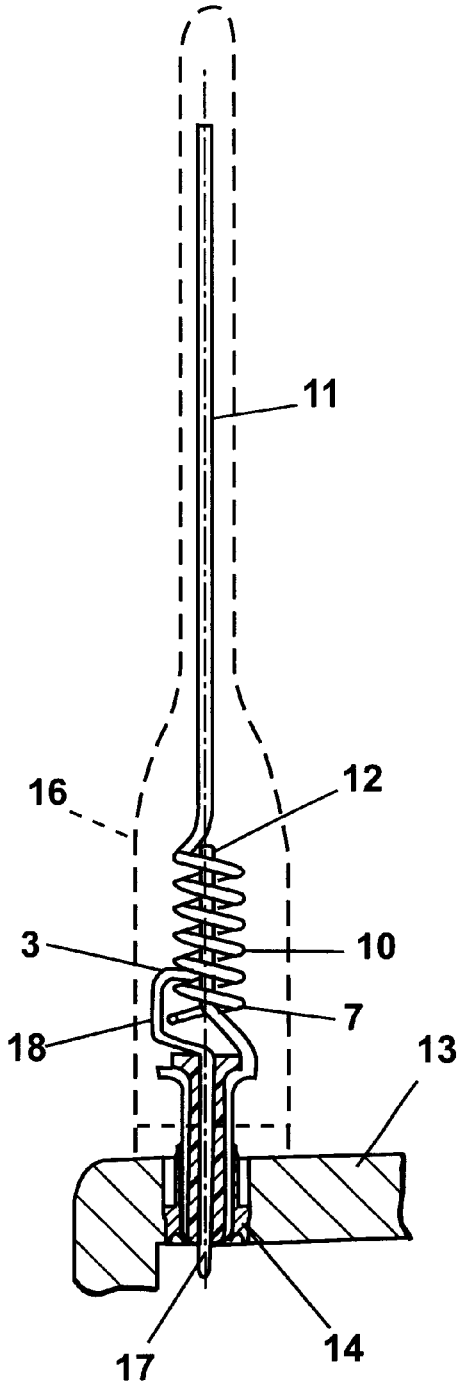
FIG. 4B shows the practical version of FIG. 4A installed in a socket.

FIG. 4 shows one example of the physical construction of an apparatus according to FIG. 2. In terms of design and construction, the difference vis-a-vis the apparatus according to FIG. 3 is only that the contact pin 17 has been upwardly extended and has a portion 18 which extends up on the outside along a portion of the coil 10. As a result, the input point 3 will be located between the ends of the coil, for which reason the coil will have a lower portion 7 which terminates as an appendix. Also in this embodiment, the concentrically disposed and earthed conductor 12 extends throughout the entire length of the coil and therefore forms a capacitance distributed continuously along the coil, both with the upper portion of the coil and with its lower portion 7. Also in this version, the conductor 12 is suitably enveloped by a tube or sleeve of dielectric material, on which sleeve the helically designed conductor 7 and 10 is wound.

It will be apparent from the right-hand portion of FIG. 4 that also this embodiment may have an outer, insulating protective housing which is illustrated by the ghosted line 16.

In one practical version of the antenna according to FIGS. 2 and 4, the rod antenna length in half wave operation and at 1800 MHz, as well as at quarter wave operation and 900 MHz is approximately 50 mm. The coil 10 has a total of approximately 10 turns, of which the lower portion 7 terminating as an appendix accommodates approximately two turns. The wire diameter in the rod 11 and the coil 10 is 0.8 mm and the coil has an inner diameter of 1.5 mm.

DESCRIPTION OF ALTERNATIVE EMBODIMENTS

Figure 5:
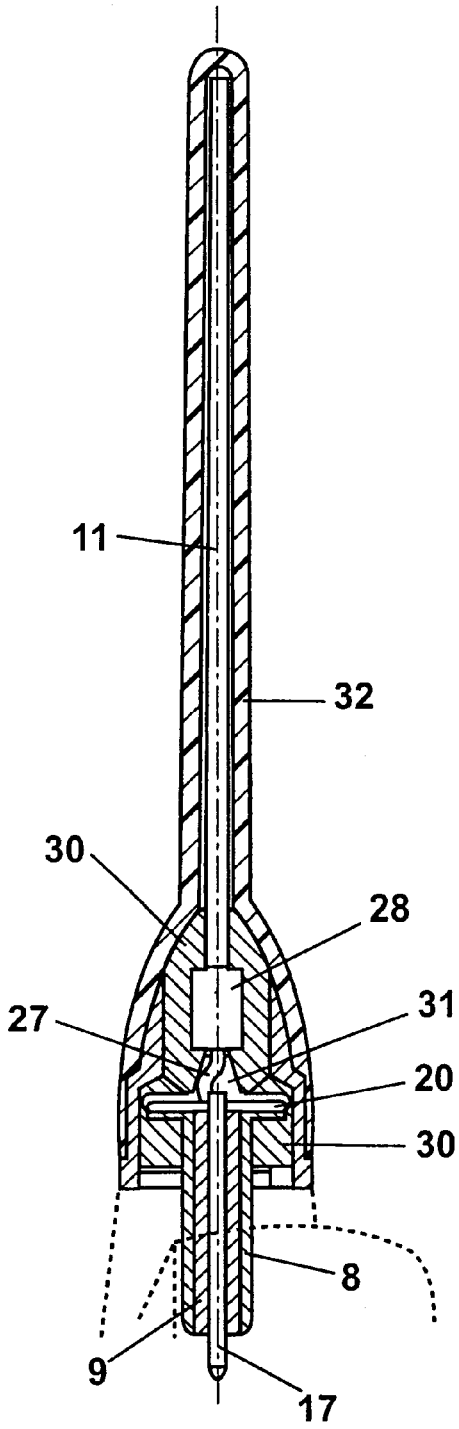
FIG. 5 shows an alternative embodiment of the present invention.
Figure 6:
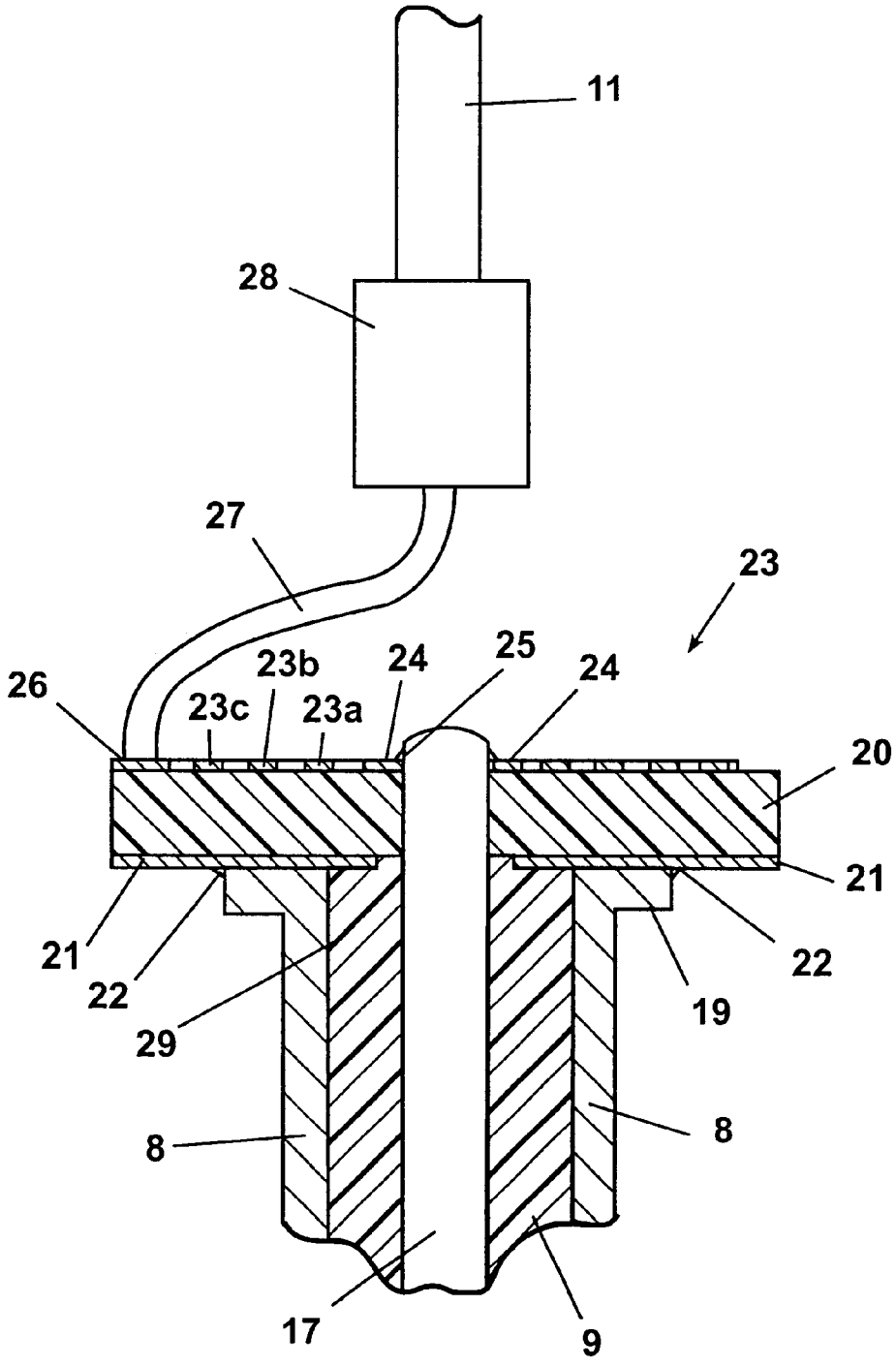
FIG. 6 is a partial magnification of FIG. 5.

FIGS. 5 and 6 show a modified embodiment of the apparatus according to the invention. In electric terms, this modified embodiment may be executed according to both FIG. 1 and FIG. 2.

It will be apparent from FIG. 5 that the antenna in this embodiment has an earthed sleeve 8 with an interior insulator 9 and a contact pin 17. At the upper end of the sleeve 8, there is a radially projecting flange 19 (FIG. 6) on which rests a washer or disk 20 of insulating material. On its underside, the disk 20 has a metal coating 21 which substantially continuously covers the entire underside of the disk. The metal coating 21 is galvanically connected to the sleeve 8 and its flange 19, for example by soldering 22.

On the upper side of the disk 20, there is disposed a helical conductor 23 which is planar and is secured on the disk. The spiral 23 has an inner or central connecting portion 24 which, via soldering 25, is connected to the upper end of the contact pin 17. The various turns 23*a*, 23*b*, 23*c*, etc., of the helical spiral extend around the connecting portion 24. At one outer portion of the spiral 23, this is provided with an outer connecting portion 26 in which a conductor 27 is soldered. The conductor 27 extends to a position a slight distance above the upper end of the contact pin 17 where it is galvanically connected to a coupling 28 which also galvanically connects to a rod antenna 11.

If the outer connecting portion 26 is located at the outer end of the spiral 23, there will be realized an apparatus of the type illustrated in FIG. 1. If, on the other hand, the connecting portion 26 is located between the ends of the spiral, i.e. partly in from the outer end of the spiral, there will be realized an apparatus of the type illustrated in FIG. 2.

As has been mentioned above, the spiral 23 is substantially planar and its different turns may be substantially circular or round, but may also be designed as a polygon, for example with four or more sides.

In one practical version, the disk 20 is ideally a double-sided circuit card and the spiral 23 is produced by etching of the upper face of the circuit card, while the under face of the circuit card is left untouched.

It will be apparent from FIG. 6 that the lower metal layer 21 on the disk 20 has an aperture 29 through which the contact pin 17 extends without forming any galvanic contact with the metal layer 21. As a result of this feature, there will be achieved a capacitance distributed over the spiral 23 which is realized by the metal layer 21 and which may suitably have an extent which corresponds to the outer contour of the spiral 23.

In order not to cause unnecessary losses, the spiral 23 is, as far as possible, enveloped by a gaseous dielectric, preferably air. This, as is apparent from FIG. 5, is realized in that at least a part of the coupling 28 and an upper portion of the sleeve 8 (preferably its flange 19) are enclosed in a retainer body 30 which has a cavity 31 surrounding the disk 20 and the conductor 27. An insulating protective casing 32 is then disposed on the outside of the retainer body 30.

In one practical embodiment of the antenna according to FIGS. 5 and 6, the rod 11 in half wave operation has a length of 110 mm at 900 Mhz, and approximately 50 mm at 1800 MHz. The conductor 27 has a length of approximately 6 mm and a diameter of 0.8 mm. The circuit card 23 has a laminate thickness of 0.8 mm and a diameter of 8 mm. At 1800 MHz and half wave operation, the plarar etched coil 23*a*–23*c* has approximately 1.3 turns, in which each turn has a thickness (radial width) of approximately 0.5 mm. At 900 Mhz and half wave operation, the number of turns is approximately 2.8. The protective outer casing surrounding the rod 11 has an outer diameter of approximately 11 mm, and the antenna a total length of approximately 65 mm, designed for 1800 MHz and half wave operation.

In all of the above-described embodiments, the radiator 1 has been illustrated as a rod, but, of course, this may be of other design, for example as a helix.

As an alternative to employing a double-sided circuit card in production of the disk 20, a single-sided such card may be employed. In order, in this alternative, to realise a counterpart to the metal layer 21, the flange 19 is extended in the radial direction so as to cover substantially the whole of the underside of the disk 20 and thereby replace the metal layer 21.

As an alternative to the galvanic coupling (via the conductor 27) between the lower end of the rod 11 and the spiral conductor 23, both capacitative and inductive coupling may be employed.

A capacitative coupling will be realized if the lower end of the rod 11 is galvanically connected to a metal plate which is approximately parallel with the plane of the spiral conductor 23 and which is designed in slight spaced apart relationship therefrom. The gap between the plate and spiral conductor 23 may be filled with air but may also contain a dielectric material such as the insulating layer in a single-sided circuit card in which the plate has been worked into its upper, conductive metal layer.

The inductive coupling, may be realized if the plate is replaced by a spiral.

FIGS. 7–10 illustrate an antenna apparatus which has two different radiators, of which one is used in the stand-by mode, while the other is employed during talk.

Figure 7:
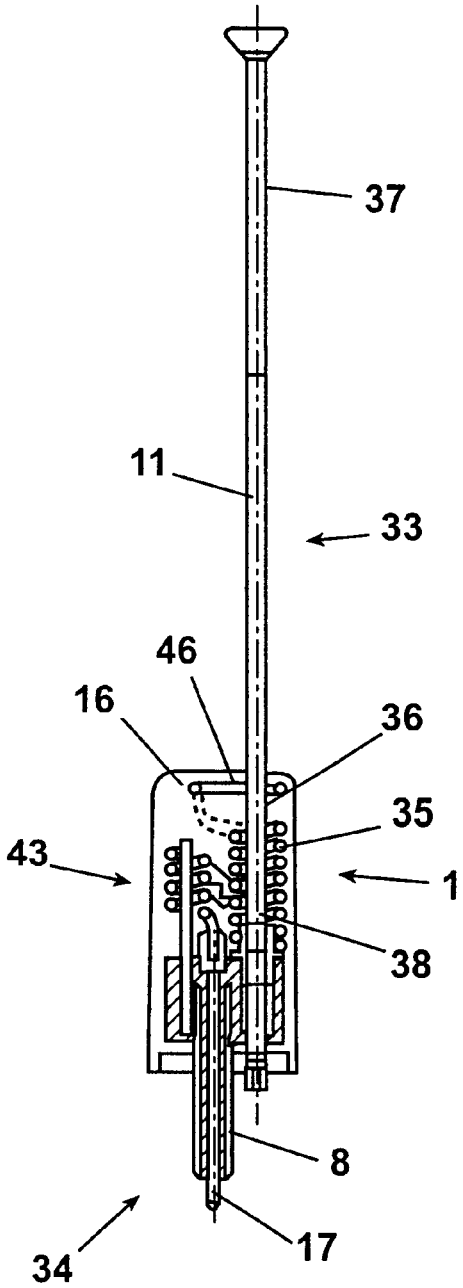
FIG. 7 is a schematic cross section through a modified embodiment comprising two radiators, of which one is a rod radiator which is in the protracted state.

In FIG. 7, reference numeral 1 relates to a first radiator and reference numeral 33 to a second radiator. The radiators 1 and 33 are arranged, via a coupling device, such that when the first radiator 1 is active, the second radiator 33 is passive, and vice versa. This is achieved via a mechanical coupling device whereby the radiators are alternatingly connectable to a transceiver (not shown on the Drawing) which, via a suitable conductor, is connected to the terminal 34 of the antenna apparatus. Possibly, both of the radiators may be galvanically connected in parallel when the second radiator 33 is in the active state.

Figure 8:
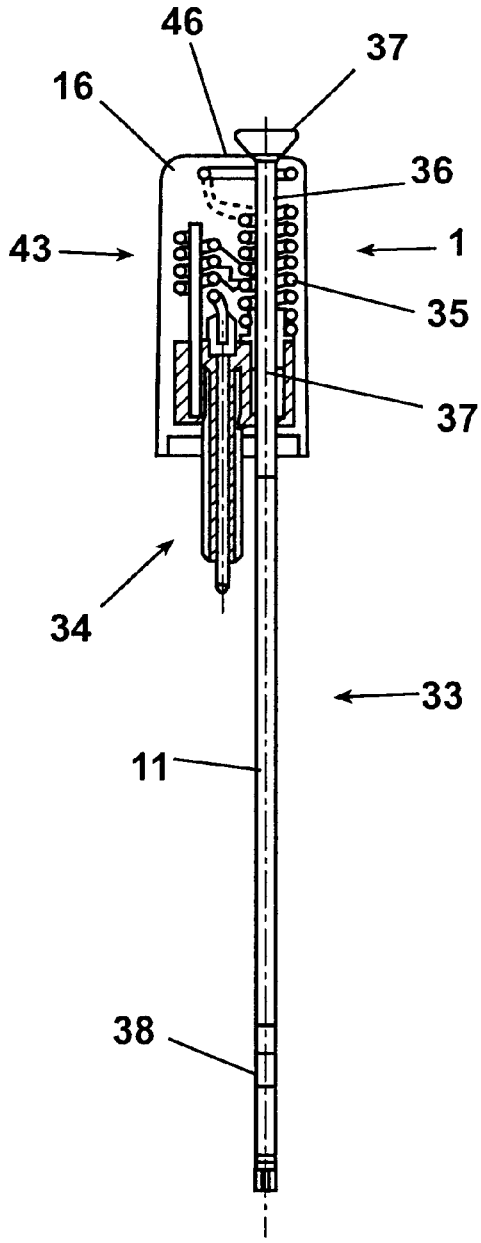
FIG. 8 shows the antenna apparatus of FIG. 7 with the rod radiator in the retracted state.

The second radiator is designed as a rod 11 which is shiftable in its longitudinal direction from the protracted position of use (the active position) according to FIG. 7 to the retracted and passive position according to FIG. 8. In such instance the rod 11 extends through the first radiator 1 which is designed as a helix 35. The helix is, according to the invention, cast or otherwise disposed internally in a protective body 16 produced from insulating material and provided with a channel through which the rod 11 is protractible and retractable.

In order to permit switching between the two radiators 1 and 33, the rod 11 has, in its upper end, an electrically insulating portion 37 which, in the retracted position of the rod in FIG. 8, is located interiorly in the helix 35 and extends at least along the major portion of its length. Given that the helix will hereby have an inner body of dielectric material, its radiation properties will not be appreciably affected, for which reason the helix 35 will, in this case, be active and operate without any actuation from the rod 11. At the lower end, the rod 11 has an electrically conductive portion 38 made of metal and, in the protracted position of the rod according to FIG. 7, is located interiorly in the helix 35 and extends, in the longitudinal direction, throughout substantially the entire length of the helix. By placing a metallic, electrically conductive body interiorly in the helix, this will be "short-circuited" and thereby cease lo function as radiation element. The helix 35 may, in this case, possibly be considered as a portion which is integrated in electric terms with the rod 11, or as a radiator connected in parallel with the rod.

The conductive portion 38 is, in the position of the rod 11 according to FIG. 7, coupled via the mechanical coupling device to the transceiver 4, for which reason the rod in this position will alone function as a radiator. However, the helix 35 may, in this position, be considered in electric terms as a part of the rod. Ideally, the rod has been set to half wave operation while the helix is designed for quarter wave operation. However, the rod may also be set for quarter wave operation.

Figure 9:
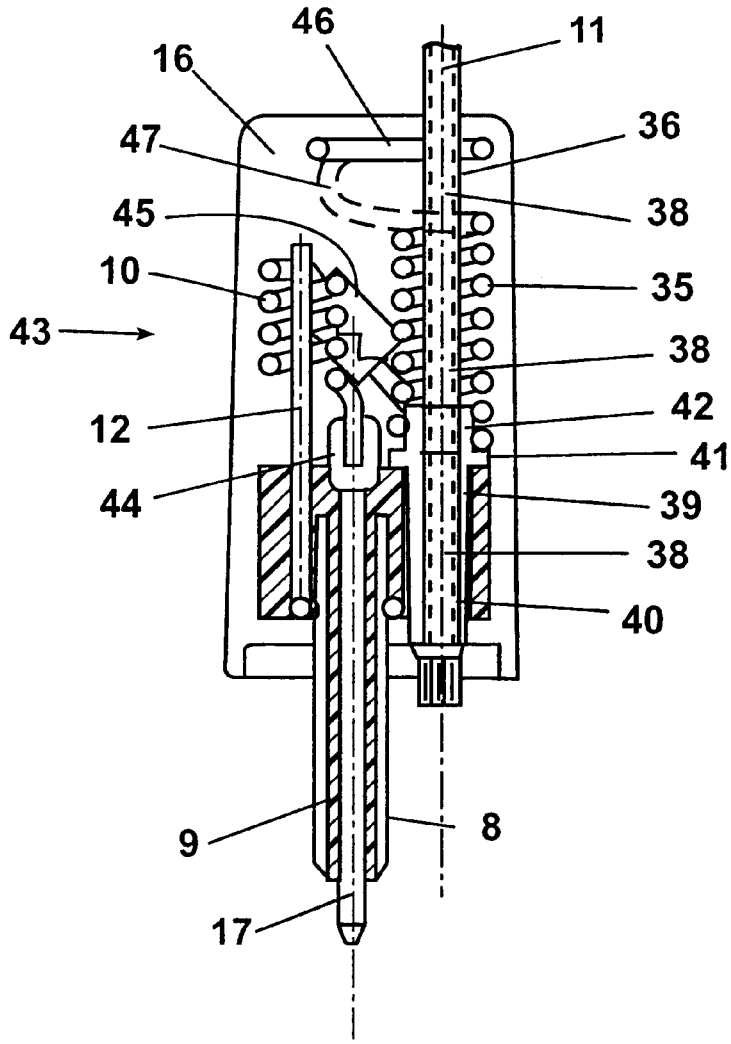
FIG. 9 is a magnified cross section through the lower portion of the antenna apparatus according to FIGS. 7 and 8.
Figure 10:
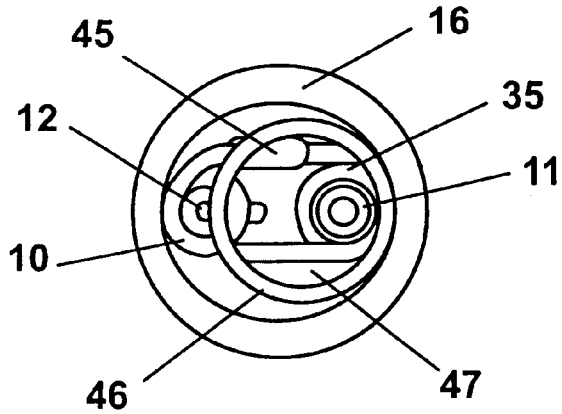
FIG. 10 is a top plan view of the antenna apparatus according to FIG. 9.

FIG. 9 shows more clearly the details and parts in the construction according to FIG. 7. It will be apparent from this Figure that the lower, conductive portion 38 of the rod 11 extends through the helix 35 substantially throughout the entire length thereof, and down into a sleeve 39 produced of metal and provided with contact fingers 40. Hereby, the rod 11 will be galvanically connected to the sleeve 39. The sleeve 39 has, in an upper region, a radially projecting flange 41 on whose upper side rests the helix 35. The sleeve 39 further extends one or slightly more than one turn interiorly up in the helix via a bushing 42 which thereby offers the possibility of positional fixing of the helix 35 so that this and the rod 11 may be kept approximately coaxial in relation to one another. The lower end of the helix is anchored in the bushing 42 and/or the flange 41 and is, galvanically connected to one or both of them.

In the retracted position according to FIG. 8, the upper, insulated portion 37 of the rod 11 will be located interiorly in the helix 35 and also extend down into the electrically conductive sleeve 39, whereby no electric contact (galvanic contact) is formed between the sleeve 39 and the rod 11. This is, hence, electrically disconnected and inactive in this position, while, on the other hand, the helix 35 is galvanically connected to the sleeve.

Both of the radiators 1 and 33 have a connection impedance of the order of magnitude of 130 Ω, while the transceiver has an impedance of approximately 50 Ω. Between the terminal 34 and the common coupling point of both radiators 1 and 33 in the region of the bushing 42 and the flange 41, there is disposed an adaptation network 43.

The terminal 34 has an inner, central conductor or contact pin 17 which is surrounded by a concentrically disposed, insulating sleeve 9. The sleeve 9 is, in its turn, surrounded by an electrically conductive sleeve 8, which is connected to earth. The contact pin 17 has, in its upper end, a joint or bracket 44 in which the lower end of the spiral conductor 10 is secured and galvanically connected to the contact pin. The upper end of the spiral conductor 10 is, via an electrically conductive joint or coupling 45, galvanically connected to the lower end of the helix 35 or to the sleeve 39 in the region of the flange 41 and/or the bushing 42.

On galvanic contact with the earthed sleeve 8, a conductor 12 extends up through the spiral conductor 10. The conductor 12 has, in its lower end, an annular formation which is accommodated and galvanically connected in a groove in the sleeve 8. The conductor 12 extends along the path of extent of the spiral conductor 10 whereby there is formed between them a capacitance which is distributed along the spiral conductor. Suitably, the conductor 12 may be straight and approximately parallel with the longitudinal direction of the rod 11 and may also be surrounded by a sleeve of electrically insulating material, such as polytetrafluorocthene (sold under the trademark Teflon®). The spiral conductor may suitably be designed as an approximately cylindrical helix, which is wound onto the above-mentioned sleeve. The earthed conductor 12 and the spiral conductor 10 together form an adaptation network for impedance adaptation of both of the radiators 1 and 33.

In the top of the helix 35, there is disposed a top loop 46, which preferably has approximately twice the diameter of the helix 35 and which may amount to approximately 1 turn. The top loop has a plane of extent which is approximately at right angles to the axis of the helix 35 and the longitudinal direction of the rod 11 and is of one piece manufacture with the helix 35 and connected to upper end thereof via a connecting portion 47 which is approximately U-shaped in side elevation. The bottom shank of this connecting portion constitutes an approximately tangentially directed continuation of the upper end of the helix 35, while the upper shank connects from beneath to the top loop 46.

In one practical version of the apparatus according to the present invention intended for the 900 Mhz band and with the helix 35 working as a quarter wave antenna and the rod 11 working as a half wave antenna, the following detailed design and construction may apply:

The rod 11 has a total length of approximately 103 mm, while its lower, electrically conductive portion has a length of approximately 78 mm, and a suitable diameter is 1.5 mm.

The helix antenna 35 comprises 8 turns distributed over a length (height) of 8.75 mm and with an inner diameter of 2.5 mm. The length (height) of the top loop 46, including connection portion 47, is 3.75 mm. The top loop comprises approximately 1 turn and has an inner diameter of 6 mm.

The spiral conductor 10 has 3.75 turns distributed over a length (height) of 4.7 mm and an inner diameter of 2 mm. The distance between the center axes of the spiral conductor 10 and the helix antenna 35 is 7 mm. The wire diameter in both the helix 35 and the spiral conductor is 0.75 mm.

It has been presupposed in the foregoing that a galvanic coupling were to take place between the lower end of the rod 11 and the sleeve 39. It is however also possible to provide a capacitative coupling between the lower end of the rod and the sleeve 39, possibly also in relation to the helix 35.

The rod 11 has been assumed to be designed as a half wave antenna, but may also be dimensioned for quarter wave operation.

The spiral conductor 10 is shown and described as a cylindrical helix, but it may also be a planar spiral which is disposed on one side of disk of insulating material, in which event this disk is provided on the opposing side with a plate which electrically corresponds to the conductor 12. The plane of extent of the plate and the outer contour of the spiral are approximately equal.

As an alternative to the contact fingers 40 of the sleeve 39, use may be made of contact fingers on the under end portion of the rod. These contact fingers or springs borne by the rod 11 are insertable from beneath into the sleeve 39 which, in this embodiment, is rigid. Regardless of whether the contact fingers are disposed in the sleeve or on the rod, they serve the double purpose of, on the one hand, galvanically interconnecting the sleeve 39 and the rod 11 and, on the other hand, of mechanically retaining the rod 11 in the protracted position.

Further modifications of the present invention are possible without departing from the spirit and scope of the appended claims.

What is claimed is:

1. An antenna apparatus for a communication device operating in the frequency range of between 800 and 3000 MHz, comprising at least one radiator which is galvanically connected to one end of a spiral conductor which in turn is connected to a transceiver at a connection point, characterized in that an earthed conductor extends along the extent of the spiral so that substantially all of the capacitance formed by the position of the earthed conductor is disturbuted along the spiral conductor.

2. The apparatus as claimed in claim 1 wherein the connection point of the spiral with the transceiver is located on an opposite end of the spiral spaced away from the radiator.

3. The apparatus as claimed in claim 1 wherein the connection point of the spiral with the transceiver is disposed between the one end and an opposite end of the spiral.

4. The apparatus as claimed in claim 1 wherein the spiral and the transceiver are galvanically interconnected with one another.

5. The apparatus as claimed in claim 1 wherein one axial direction of the spiral is substantially parallel to the longitudinal direction of the radiator.

6. The apparatus as claimed in claim 1 wherein the spiral is substantially of helical configuration and the earthed conductor is disposed concentrically in the spiral.

7. The apparatus as claimed in claim 6 and further comprising an air space between the earthed conductor and the inside of the spiral.

8. The apparatus of claim 6 wherein a sleeve of dielectric material is disposed about the earthed conductor with the spiral being wound on the sleeve.

9. An antenna apparatus for a communicating device operating in the frequency range of between 800 and 3000 MHz, the apparatus comprising:

at least one radiator;

one spiral conductor, said spiral conductor being solely connected to said radiator and a transceiver, the connection of the radiator being accomplished at one end of the spiral conductor and the connection to said transceiver at a feed point; and one conductor solely connected to earth, said conductor extending in proximity with and along the extent of said spiral conductor so that substantially all of the capacitance formed by the position of the earthed conductor is distributed along the extent of the spiral conductor.

* * * * *

UNITED STATES PATENT AND TRADEMARK OFFICE

CERTIFICATE OF CORRECTION

PATENT NO. : 6,348,900 B1
DATED : February 19, 2002
INVENTOR(S) :Carl Gustaf Blom It is certified that error appears in the above-identified patent and that said Letters Patent is hereby corrected as shown below:

Column 8,
Line 56, “disturbuted” should be -- distributed --

Signed and Sealed this

Fourth Day of June, 2002

*Attest:*

*Attesting Officer*

JAMES E. ROGAN
*Director of the United States Patent and Trademark Office*